United States Patent [19]

Fencl et al.

[11] Patent Number: 4,898,006

[45] Date of Patent: Feb. 6, 1990

[54] METHOD AND APPARATUS FOR DRAWING OFF LOW BOILING MEDIA FROM PRESSURE SYSTEMS

[75] Inventors: Zdeněk Fencl; František Janda; Karel Kovařík, all of Prague; Jiří Šára, Revnice; Antonin Tatoun, Prague, all of Czechoslovakia

[73] Assignee: Kovoslužba n odní podnik hlavního města Prahy, Prague, Czechoslovakia

[21] Appl. No.: 256,833

[22] Filed: Oct. 12, 1988

[51] Int. Cl.[4] ..... F17C 3/10

[52] U.S. Cl. ..... 62/48.2; 220/85 VR

[58] Field of Search ..... 62/54; 220/85 VS, 85 VR

[56] References Cited

U.S. PATENT DOCUMENTS 4,249,387 2/1981 Crowley ..... 62/54

4,332,136 6/1982 Quack ..... 62/54

*Primary Examiner*—Ronald C. Capossela

*Attorney, Agent, or Firm*—Beveridge, DeGrandi & Weilacher

[57] ABSTRACT

In order to provide for the drawing off of residual vapors of a low boiling liquid from a pressure system into a storage vessel, the pressure between the system and the storage vessel is first equalized, whereafter the pressure in the storage vessel is reduced and the pressure in the pressure system increased, thereby enabling passage of the low boiling liquid, and its associated vapors in the liquid state, into the storage vessel. This process can be repeated in order to draw off all liquid with its vapors from the pressure system.

6 Claims, 2 Drawing Sheets

METHOD AND APPARATUS FOR DRAWING OFF LOW BOILING MEDIA FROM PRESSURE SYSTEMS

FIELD OF THE INVENTION

The invention relates to a method for drawing off low boiling liquid media from pressure systems whereby the low boiling medium is pumped off from the pressure system into a storage vessel. The invention also relates to an arrangement for carrying out of the method comprising a drawing off conduit connected at one end thereof to the pressure system and connected at the other end thereof, by way of auxiliary elements, to a storage vessel for the low boiling medium.

BACKGROUND OF THE INVENTION

By way of background, it is noted that the term "pressure system" as used herein generally refers, for instance, to a cooling circuit comprising a cooling device, a collector of a liquid cooling medium of a cooling circuit as well as to any vessel for a low boiling medium, e.g., a transport vessel for a liquid cooling medium, a storage vessel of a low boiling medium for filling of fire extinguishers and the like. Further, the expression "low boiling liquid" or "low boiling media" generally refers to, for example, fluorinated and chlorinated hydrocarbons used, e.g., as cooling agents and identified by the name Freon, as well as to halogenated hydrocarbons used for fire extinguishers, liquefied gasses and all other liquids having a low boiling point lower than 80° C. at normal barometric pressure.

In different industrial branches, businesses and services, health services, agriculture and households, systems and arrangements are used which employ, as a working agent, a low boiling medium contained within a pressure system. In many instances, these workings agents are objectionable, i.e., present problems, for reasons of health and hygiene, and sometimes for ecological reasons as well. Such media characteristically have to be drawn off on a frequent bases from the pressure systems. These media are in many cases discharged into the atmosphere; alternatively, specially designed pumping devices are used and in such instances, residual vapors of the cooling agent, which remain after pumping off of the liquid, cannot be easily removed. For instance, in cases where for some reason the cooling agent from condensation cooling units and cooling circuits must be removed or pumped off, vapors of the cooling agent are generally discharged into the surrounding atmosphere. It is a widely accepted fact that fluorinated and chlorinated hydrocarbons used as cooling agents affect the protective ozone layer of the atmosphere thereby significantly influencing the global environmental conditions. Accordingly, much worldwide attention has been focused on how to prevent the leakage of such cooling agents into the atmosphere.

In presently known arrangements provided for drawing off of cooling agents, such as described, for instance, in German Federal Republic Patent No. 3,001,224, (based on U.S. application), the problem of drawing off vapors of cooling agents from cooling circuits and condensation units has been addressed. However, because of the nature of the pumping provided and the undercooling provided by the cooling unit, and due to distillation of the cooling agent, a substantial part of contaminants contained in the liquid cooling agent remain in the circuit. This is particularly true of products ranging from built-in electric motors which are damaged due to short circuits, to semi-hermetic and hermetic compressors, contaminated oil and other contaminants which, under prevailing conditions, have a boiling temperature higher than that of the cooling agent used. Because practically the entire amount of cooling agent is pumped off by way of a suction filter and a compressor which is generally of a hermetic design, the life-time of the compressor is reduced, the consumption of electric power is increased and the suction filter is required to be changed frequently. Further, prior art arrangements of this kind have usually an overall weight around 50 kg, and are costly. Further, handling of these arrangements or units is difficult and physically demanding.

SUMMARY OF THE INVENTION

In accordance with the present invention, a method and an arrangement are provided for the removal of similar low boiling cooling agents in such a manner that no undercooling of the pressure system occurs, the temperature of the cooling agents increases during the course of its removal, the storage vessel to which the cooling agent is pumped is subject to undercooling, the major part of contaminants dissolved in the liquid phase are carried along with the agents, and any residue from the low-boiling medium is also removed.

According to the method of the invention, after establishing pressure equilibrium between the pressure of the pressure system and the pressure of the storage vessel to which the cooling agent is pumped from the pressure system, the pressure in the storage vessel is reduced and the pressure in the pressure system is increased. Vapors from the storage vessel are suctioned off into the pressure system and due to the resultant pressure difference established, the low boiling medium is drawn off from the pressure system into the storage vessel.

The result of this method of operation is that, due to the high pressure difference obtained between the pressure system and the storage vessel, a relatively large increase is provided in rate of pumping off the medium. This effect is obtained by provision of a drawing off conduit connecting the pressure system to the storage vessel and of a return conduit to which a compressor is connected. The major part of the low boiling medium is pumped off by way of the drawing off conduit in a liquid state out of the path of the compressor, which is thus attacked to only a slight degree by vapors of the low boiling medium, thereby resulting in a prolonged life for the compressor. In addition, in the course of the process of drawing off of the liquid, no unwelcome undercooling of the pumped off pressure system is experienced. In fact, the temperature of the pressure system is, on the contrary, increased, and the storage vessel is undercooled. Another advantage is that the pumped off, low boiling liquid carries along with it the major part of the unwanted constituents, i.e., contaminants, which are dissolved in the liquid phase. By providing a condenser in a separate conduit, the drawing off of any residue of the low boiling medium as a vapor can be achieved.

The arrangement for carrying out the method according to this invention provides a speed or rate of drawing off the low boiling medium which is five times higher than that of arrangements according to the present state of the art. The weight of a unit in accordance with the invention is less than half of the weight of prior art units, so that the unit of the invention is easily transportable and can be used directly on site, for instance at a damaged cooling system. A prototype of an arrangement operating according to the present invention, and utilized for instance for pumping off a liquid cooling agent known under the commercial term "Freon R 12" from a pressure system, in the form of a collector for a condensation cooling unit of a content of 15 kg, has provided a current pumping off rate of 70 kg of cooling agent per hour, whereas the weight of the arrangement is merely 21 kg. Prior art arrangements utilized for the same purpose which achieve a maximum pumping off rate of 10 kg per hour have a weight of about 50 kg.

Other features and advantages of the invention will be described in, or apparent from, the detailed description of preferred embodiments of the invention which follows.

DETAILED DESCRIPTION OF THE PREFERRED EMBODIMENTS

Figure 1:
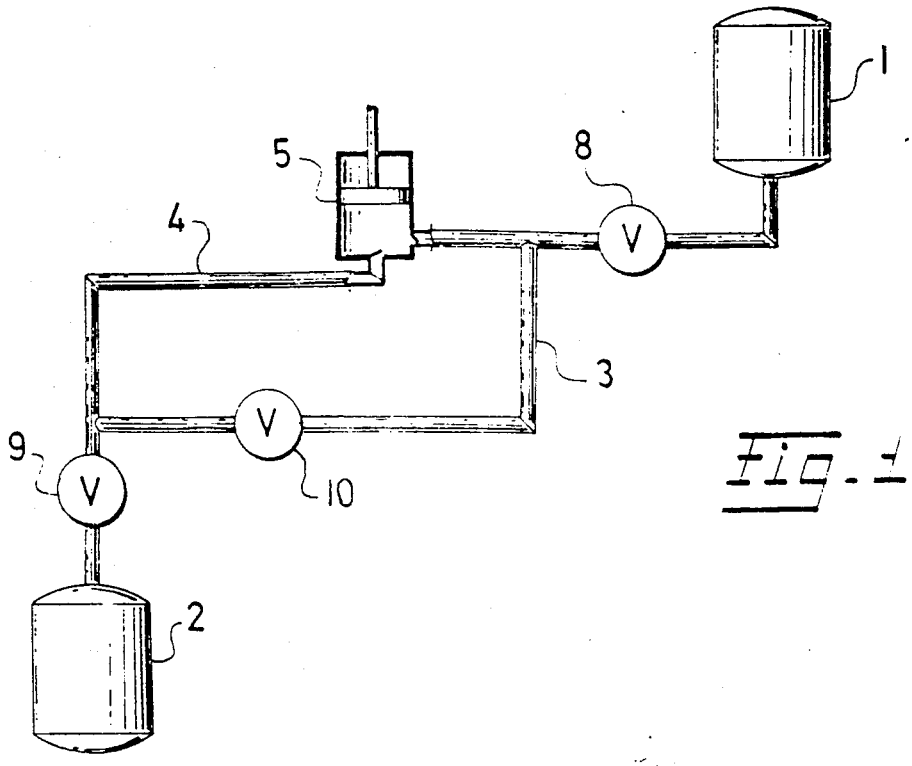
FIG. 1 is a fluid circuit diagram of a drawing off or suction arrangement in accordance with a preferred embodiment of the invention showing the interconnections of the components of the working circuit, and indicating the connections between the pressure system and the storage vessel provided by a drawing off conduit and a return conduit.

Referring to FIG. 1, a pressure system 1 is shown which is connected to a storage vessel 2 by means of a drawing off conduit 3, the drawing off conduit 3 being provided with, i.e., having connected therein, a first closing device (control valve) 10. A return conduit 4, including a compressor connected therein, is connected at the ends thereof across, i.e., in parallel with, the drawing off conduit 3. The pressure system 1 is provided with its own closing device (control valve) 8 and the storage vessel 2 is also provided with a closing device (control valve) 9.

In operation of the arrangement according to FIG. 1, the pressure difference between the pressure systems 1 and the storage vessel 2 is eliminated by opening the closing device 8 of the pressure system 1, opening the closing device 9 of the storage vessel 2 and opening the first closing device 10. After this pressure difference is eliminated, the first closing device 10 is closed and the compressor 5 is started, so that the return conduit 4 suctions off the vapors associated with the low boiling medium from the storage vessel 2 and directs these vapors back into the pressure system 1, thereby simultaneously reducing the pressure in the storage vessel 2 and increasing the pressure in the pressure system 1. After a required pressure difference is obtained, the compressor 5 is stopped and the first closing device 10 is again opened. Because of the established pressure difference, the low boiling medium flows in a liquid state by way of the drawing off conduit 3 into the storage vessel 2 until the pressure difference is again eliminated, wherein after the compressor 5 is again started, and the first closing device 10 closed. Thus, the whole cycle is repeated until all of the low boiling medium from the pressure system 1 is suctioned off by exchanging the pressure system 1 for the storage vessel 2, after which the first closing device 10 is closed and the compressor 5 started. The closing device 8 of the pressure system 1 and the closing device 9 of the storage vessel 2 remain open for the entire time during which drawing off of the medium takes place.

Figure 2:
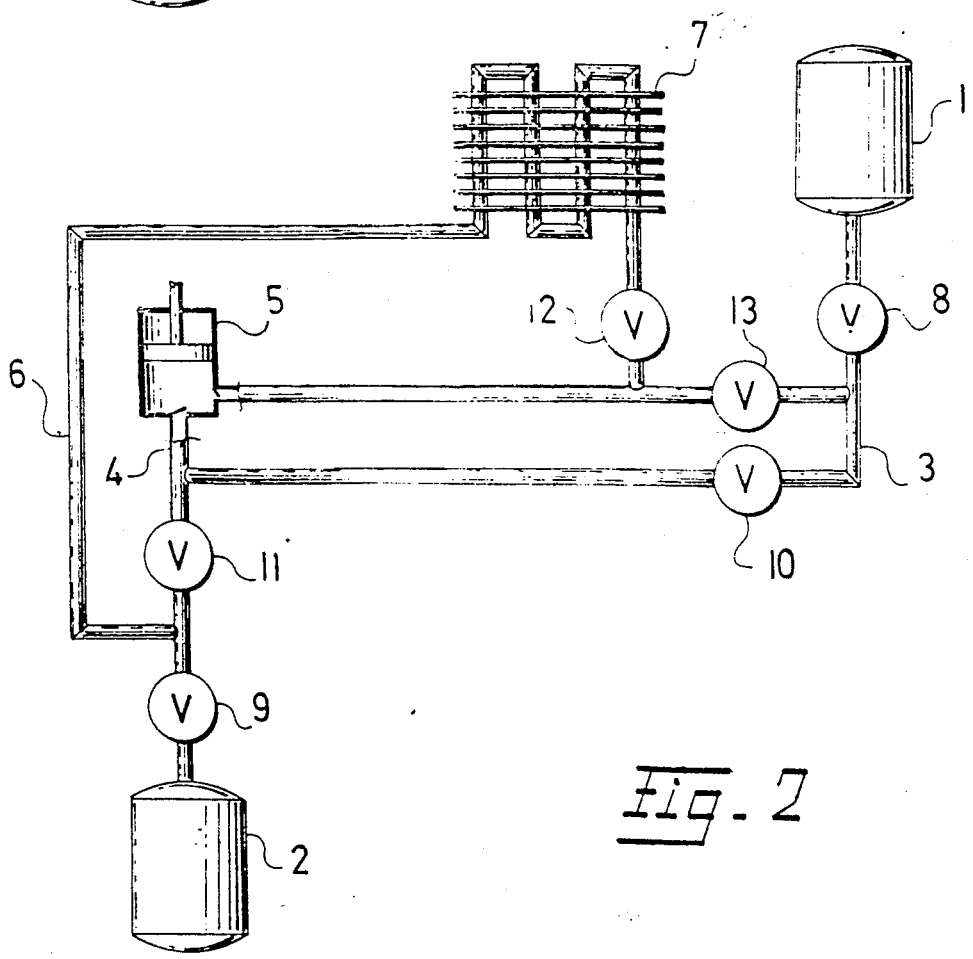
FIG. 2 is a diagram similar to FIG. 1 showing an arrangement including the interconnection of a separate conduit to a condenser.

FIG. 2 shows an arrangement or system similar to FIG. 1 wherein a pressure system 1 is connected to a storage vessel 2 by way of a drawing off conduit 3 including a first closing device (control valve) 10 and a second closing device (control valve) 11. A return conduit 4, including a compressor 5 and a fourth closing device (control valve) 13 incorporated therein is again connected across the drawing off conduit 3. The pressure system 1 is provided with an associated closing device 8 and the storage vessel 2 with an associated closing device 9. The storage vessel 2 is connected, by means of a separate conduit 6, including a condenser 7 and a third closing device 12 connected therein, to the pressure outlet of the compressor 5.

Considering the operation of the arrangement according to FIG. 2, in order to establish pressure equilibrium between the pressure system 1 and the storage vessel 2, the first closing device 10 and the second closing device 11 are opened. After the pressure difference is eliminated, the first closing device 10 is closed and the fourth closing device 13 is opened, while the second closing device 11 remains opened. The compressor 5 is started which suctions off, over the return conduit 4, vapors of the low boiling medium from the storage vessel 2 and directs these vapors back into the pressure system 1, thereby creating a simultaneous pressure reduction in the storage vessel 2 and pressure increase in the pressure system 1. After the required pressure difference is obtained, the compressor 5 is stopped and the first closing device 10 is again opened. At this time, the fourth closing device 13 either can be closed or can remain opened. Due to the established pressure difference, the low boiling medium flows, in a liquid state, through the drawing off conduit 3 until again the pressure difference is eliminated, wherein after the compressor 5 is again started, the first closing device 10 is closed, the fourth closing device 13, insofar as it was not maintained opened, is opened, and the whole cycle is repeated until all low boiling medium is drawn off. The residue of vapors of the low boiling medium is suctioned off by opening the first closing device 10, closing the closing devices 11 and 13, starting the compressor 5, and opening the third closing device 12 so that, by way of the condenser 7, the liquefied low boiling medium is forced into the storage vessel 2.

In general, closing devices which do not perform a particular function during the course of individual stages are normally closed, and the closing device 8 of the pressure system 1 and the closing device 9 of the storage vessel 2 are opened during the course of the drawing off of the low boiling medium. The drawing off of the low boiling medium can also be achieved by opening the third closing device 13 by way of the condenser 7 over the separate conduit 6. The compressor 5 is thereby at a standstill and the first closing device 10 is closed.

Figure 3:
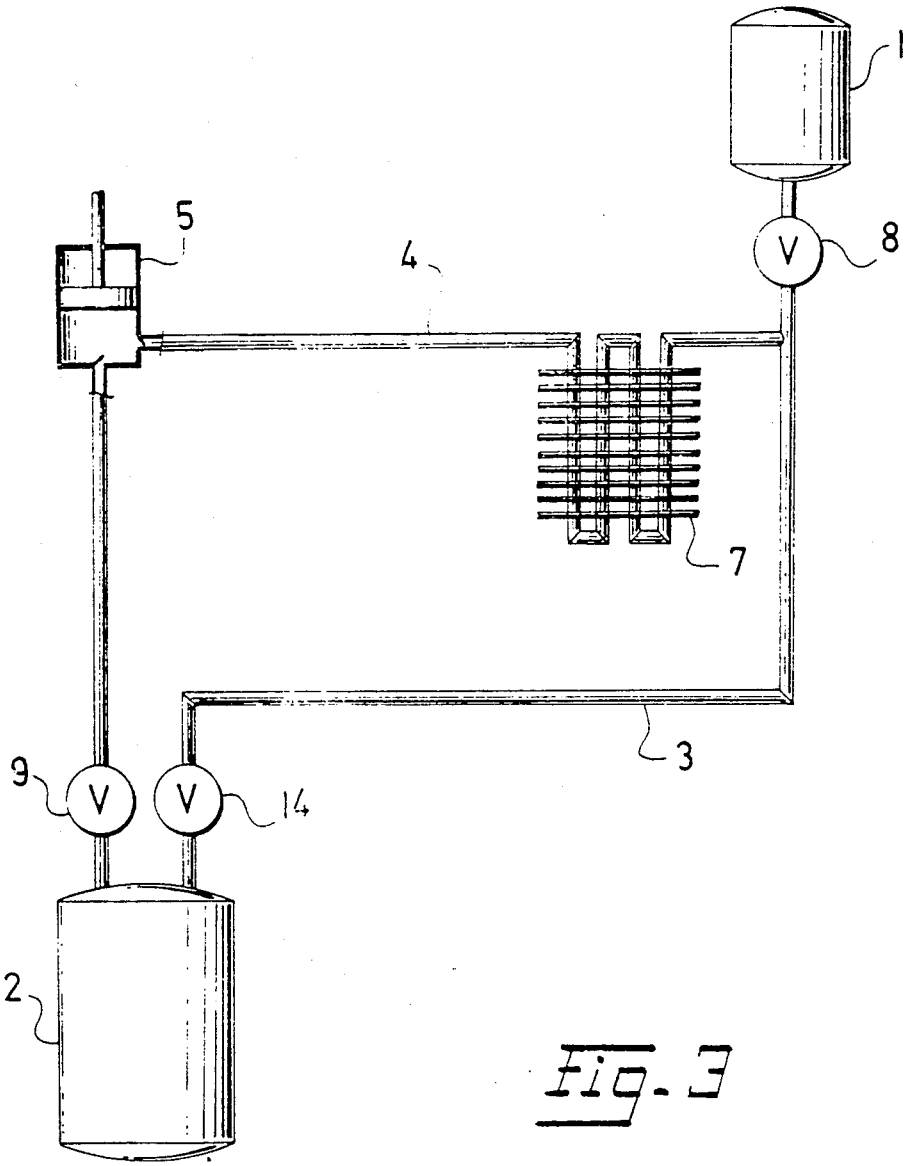
FIG. 3 is a diagram similar to FIG. 1 showing an arrangement including the interconnection of a storage vessel with two outlets.

FIG. 3 shows a pressure system 1 connected with a storage vessel 2 by means of a drawing off conduit 3. The storage vessel 2 is, in this case, provided with a closing device 9 and a condenser 7 is connected in the return conduit 4 at the pressure side of a compressor 5 with a second closing device 14. The operation is the same as described with reference to FIG. 1.

The arrangement described above can be also used, for instance, for pumping off of low boiling media, particularly of cooling agents from transport vessels to pressure transport vessels, and for pumping over from one vessel to another, for instance in order to regenerate cooling agents. In the later instance, the liquid cooling agent can be pumped, as needed, over by way of a regenerating filter either directly, in which case the vessel with the contaminated cooling agent connected to the suction part of the arrangement described above is reversed with its closing device downwards, thus providing a direct pumping over of the liquid medium, with the arrangement operating as has been described. On the other hand, where distillation of the cooling agent is required, the arrangement is operated under conditions providing suctioning off of vapors and the vessel with the contaminated cooling agent serves in this case as an improper evaporator, being in its fundamental position, i.e., with the valve upwards. The whole arrangement can be very easily automated by using electrically controlled closing elements, pressure pick-ups and pick-ups for the passage of liquid.

Although the present invention has been described relative to exemplary embodiments thereof, it will be understood by those skilled in the art that variations and modifications can be effected in these exemplary embodiments without departing from the scope and spirit of the invention.

We claim:

1. A method for drawing off low boiling media from a pressure system into a storage vessel, comprising the steps of:

eliminating pressure difference between said pressure system and said storage vessel;

increasing the pressure in said pressure system and reducing the pressure in said storage vessel by suctioning off vapors from said storage vessel and directing said vapors into said pressure system; and drawing off the low boiling media from said pressure system into said storage vessel.

2. An arrangement for drawing off low boiling media from a pressure system into a storage vessel, comprising:

a pressure system;

a storage vessel;

a drawing off conduit, connecting said pressure system to said storage vessel, for drawing off the low boiling media from said storage vessel when the pressure in said pressure system is increased and the pressure in said storage vessel is reduced;

a return conduit connected between said pressure system and said storage vessel; and a compressor disposed in said return conduit.

3. An arrangement as claimed in claim 2 wherein the ends of said return conduit are connected to said drawing off conduit, and a conduit closing device is disposed in said drawing off conduit.

4. An arrangement as claimed in claim 2 further comprising:

a condenser connected in said return conduit on the pressure side of said compressor.

5. An arrangement as claimed in claim 3 further comprising:

a second closing device connected in said drawing off conduit downstream of said first closing device;

a branch conduit connected to said drawing off conduit downstream of said second closing device and to said return conduit on the pressure side of said compressor; and a condenser and a third closing device connected in said branch conduit.

6. An arrangement as claimed in claim 5 further comprising:

a fourth closing device connected in said return conduit upstream of the connection of said return conduit to said drawing off conduit.

* * * * *